United States Patent [19]

Paxon et al.

[11] Patent Number: 5,036,360

[45] Date of Patent: Jul. 30, 1991

[54] MOISTURE COMPENSATION FOR ELECTROSTATOGRAPHIC APPARATUS

[75] Inventors: James F. Paxon; Duane J. Schommer, both of Rochester, N.Y.

[73] Assignee: Eastman Kodak Company, Rochester, N.Y.

[21] Appl. No.: 482,612

[22] Filed: Feb. 21, 1990

[51] Int. Cl.[5] ..... G03G 21/00

[52] U.S. Cl. ..... 355/208; 355/219; 355/228; 355/246; 355/274; 355/315

[58] Field of Search ..... 355/208, 207, 271, 273, 355/274, 275, 215, 315, 210, 246, 308, 219

[56] References Cited

U.S. PATENT DOCUMENTS

| | | | |
|---|---|---|---|
| 3,781,105 | 12/1973 | Meagher | 355/208 X |
| 3,788,739 | 1/1974 | Coriale | 355/210 |
| 3,816,756 | 6/1974 | Bresnick | 355/246 X |
| 3,837,741 | 9/1974 | Spencer | 355/274 |
| 3,877,416 | 4/1975 | Donohue et al. | 118/645 |
| 4,401,383 | 8/1983 | Suzuki et al. | 355/273 X |

FOREIGN PATENT DOCUMENTS 0111960 7/1983 Japan .

OTHER PUBLICATIONS

In re Donohue, U.S.P.Q., vol. 193, No. 3, Mar. 10, 1977, pp. 136–138.

*Primary Examiner*—A. T. Grimley
*Assistant Examiner*—J. E. Barlow, Jr.
*Attorney, Agent, or Firm*—Milton S. Sales

[57] ABSTRACT

An electrostatographic reproduction apparatus transfers a toner image from an image member to a receiver sheet by applying an electric field between the image member and the receiver sheet in a direction urging the toner image to the receiver sheet. A programmed power supply is adapted to (1) generate a pre-set constant current across the applied electric field during an adjustment period and (2) lock onto the voltage that supplies the set-point current for the reminder of a reproduction run. The value of the voltage is used to automatically adjust the value of an least one electrostatographic process element. The electrostatographic process element to be adjusted may be at least one of detack bias, detack duration, initial voltage $V_0$, exposure $E_0$, developement bias $V_B$, copy sheet conditioning, and copy sheet drying.

9 Claims, 2 Drawing Sheets

MOISTURE COMPENSATION FOR ELECTROSTATOGRAPHIC APPARATUS

BACKGROUND OF THE INVENTION

1. Technical Field

This invention relates generally to electrostatographic reproduction apparatus, and more particularly to automatic adjustment of process element values to compensate for changes in relative humidity.

2. Background Art

Humidity changes affect several factors relevant to the electrostatographic reproduction process. Transfer of toner images from a photoconductor member to a receiver sheet is one of those factors affected by changes in moisture.

Biased drum transfer devices consist of a rotatable conductive core having a relatively non-conductive surface layer. For maximum efficiency, the transfer field generated by the transfer drum must be kept constant under varying conditions. Changes in humidity result in resistivity changes in the bias drum material.

U.S. Pat. No. 3,837,741 discloses a system for improving transfer by compensating for changes in relative humidity by controlling the transfer bias by applying a constant current source to the drum material, sensing the voltage across the material, and controlling the transfer voltage accordingly. Since the resistivity of the drum material varies with changes in humidity, the voltage applied to the drum to maintain a constant current likewise varies with humidity.

Transfer is not the only process affected by relative humidity. For example, detack efficiency is a direct function of the mositure content of the receiver sheet. Once the receiver sheet has become intimately held by the photoconductor member by electrostatic attraction, it becomes difficult to remove. The attractive force varies with the moisture content of the receiver sheet, which is itself a function of the relative humidity. Detack is the process of stripping the receiver sheet with transferred toner image from the photoconductor member. It is accomplished in part by a detack bias charger used to reduce the electrostatic charge to loosen the bond between the receiver sheet and the photoconductor member. Care must be exercised in the selection of the detack bias to insure separation without causing image artifacts, and the moisture content of the receiver sheet plays an important role in the selection of the proper detack bias.

Other electrostatographic process element functions which exhibit effects due to changes in relative humidity include the degree of charge acceptance of the photoconductor member, the dark decay rates of charged photoconductor members, the amount of corona current generated by a corona charger in response to the application of a particular electrical source, the image density of a first print (generally darker) compared to subsequent prints, and the sensitivity of the photoconductor member to a given exposure.

DISCLOSURE OF INVENTION

It is an object of the present invention to provide a signal based on humidity in the system for controlling detack bias.

It is another object of the present invention to provide a signal, based on the electrical bias applied to a transfer roller in response to changes in humidity, for controlling other processes of electrostatographic apparatus.

It is still another object of the present invention to control detack bias based on the electrical bias applied to a transfer roller in response to changes in humidity.

These and other objects are accomplished by an electrostatographic reproduction apparatus having means for transferring a toner image from an image member to a receiver sheet by applying a voltage between the image member and the receiver sheet in a direction urging the toner image to the receiver sheet and of a value characteristic of the ambient relative humidity in the apparatus. Means responsive to the value of the voltage are provided for automatically adjusting the value of an electrostatographic process element.

In preferred embodiments of the present invention the electrostatographic process element to be adjusted is at least one of detack bias, detack duration, initial voltage $V_O$, exposure $E_O$, development bias $V_B$, copy sheet conditioning, and copy sheet drying.

According to another feature of the present invention, an electrostatographic reproduction apparatus has means for transferring a toner image from an image member to a receiver sheet by applying an electric field between the image member and the receiver sheet in a direction urging the toner image to the receiver sheet. The transferring means includes a programmed power supply adapted to (1) generate a pre-set constant current across the applied electric field during an adjustment period and (2) lock onto the voltage that supplies the set-point current for the remainder of a reproduction run. The value of the voltage is used to automatically adjust the value of at least one electrostatographic process element.

According to still another feature of the present invention, an electrostatographic reproduction apparatus includes an image member adapted to carry a toner image, and means for transferring a toner image from the image member to a receiver sheet by superposing a receiver sheet on the image member with the toner image therebetween. A detack charger is adapted to apply an electrical bias to assist separation of the receiver sheet from the image member after transfer. The electrical bias is controlled as a function of the ambient relative humidity in the apparatus.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

For a detailed explanation of the therory of copier contrast and exposure control by controlling initial voltage $V_O$, exposure $E_O$, and development bias $V_B$, reference may be made to the following article: Paxton, Electrophotographic Systems Solid Area Response Model, 22 Photographic Science and Engineering 150 (May/June 1978).

Figure 1:
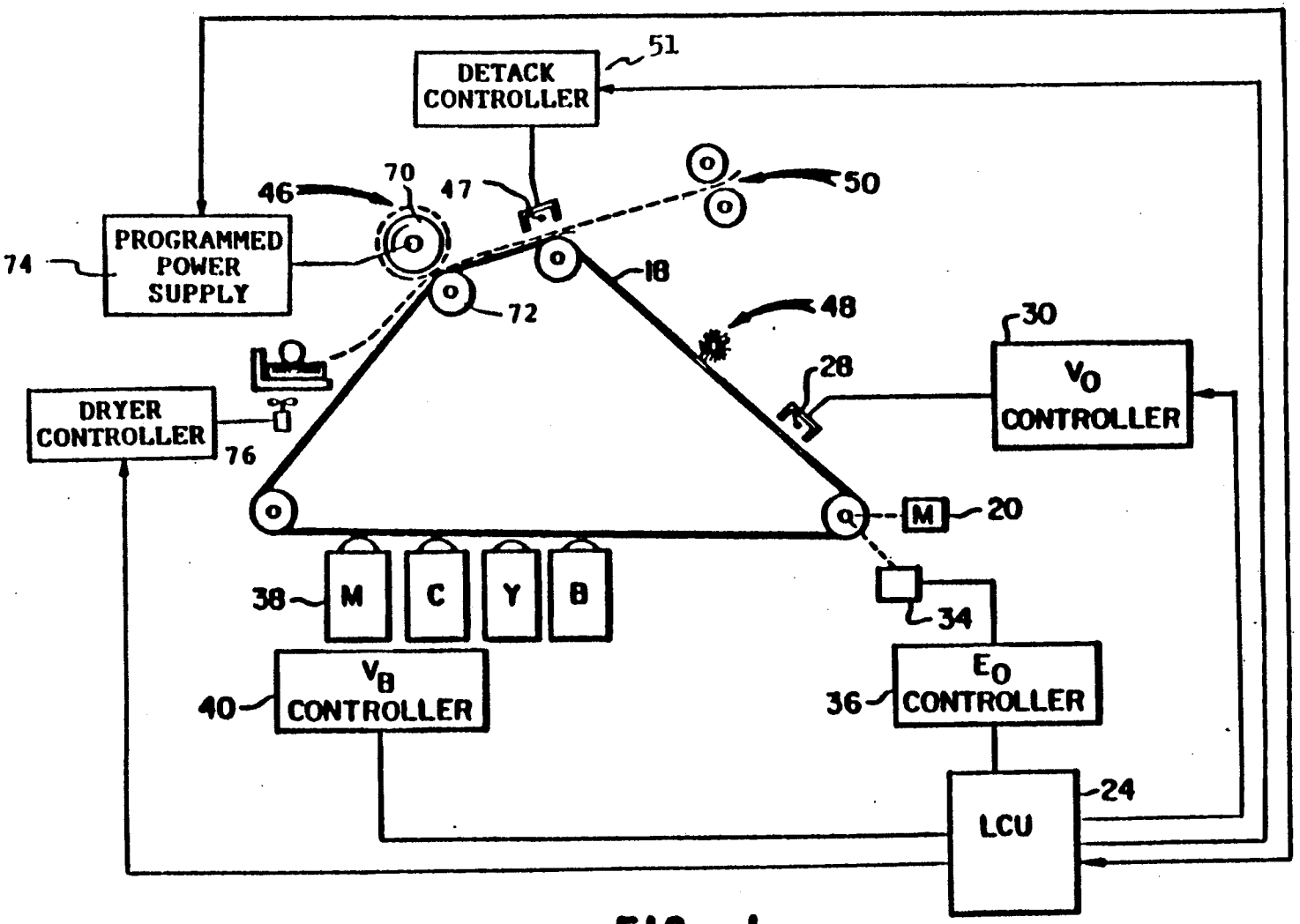
FIG. 1 is a schematic showing a side elevational view of an electrostatographic machine in which the present invention is useful.

Referring to FIG. 1, a moving image member such as photoconductive belt 18 is driven by a motor 20 past a series of work stations. A logic and control unit (LCU) 24, which has a digital computer, has a stored program for sequentially actuating the work stations.

For a complete description of the work stations, see commonly assigned U.S. Pat. No. 3,914,046. Briefly, a charging station 28 sensitizes belt 18 by applying a uniform electrostatic charge of predetermined primary voltage $V_O$ to the surface of the photoconductive belt. The output of the charger is regulated by a programmable controller 30, which is in turn controlled by LCU 24 to adjust primary voltage $V_O$.

At an exposure station 34, light imagewise dissipates the electrostatic charge on the image member to form a latent image of a document to be copied or printed (i.e., reproduced). Exposure station may be digital, having a light emitting diode or laser write head for exposing the image member picture element by picture element with an intensity and/or duration regulated by a programmable controller 36 as determined by LCU 24. Alternatively, exposure may be by means of optical projection of light reflected from an original document; the light sorce intensity being regulated by controller 36.

Travel of belt 18 brings the areas bearing the latent charge images into a development station 38. The development station has a magnetic brush for each color toner in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 selectively activates the development station in relation to the passage of the image areas containing latent images to selectively bring the magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes. The electrodes are connected to a variable supply of D.C. potential $V_B$ regulated by a programmable controller 40. A transfer station 46, a detack 47, and a cleaning station 48 complete the film loop. After transfer of the unfixed toner images to a receiver sheet at station 46, such sheet is separated from belt 18 at detack 47 and transported to a fuser station 50 where the image is fixed. Detack bias is regulated by a controller 51.

Figure 2:
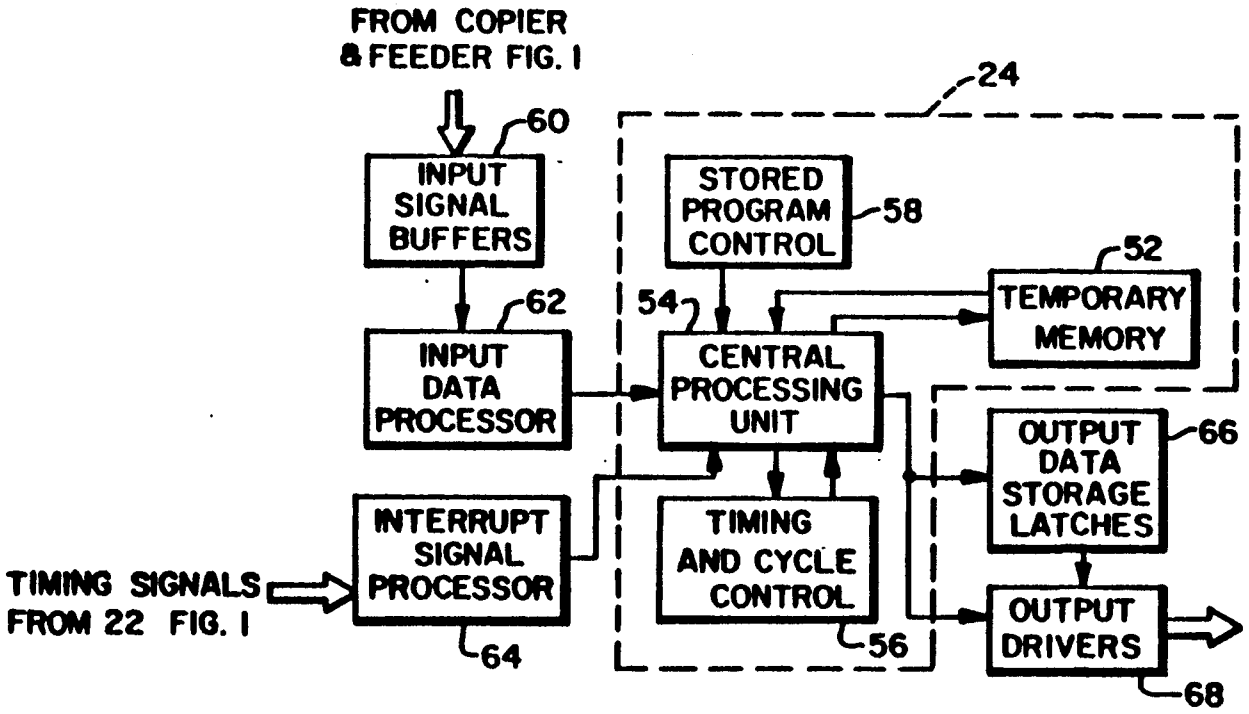
FIG. 2 is a block diagram of the logic and control unit shown in FIG. 1.

Referring to FIG. 2, a block diagram of a typical LCU 24 is shown. Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor. The LCU consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters. The output data and control signals are applied directly or through storage latches 66 to suitable output drivers 68. The output drivers are connected to appropriate subsystems.

Referring to FIG. 1, transfer station 46 will be discussed in more detail. A transfer drum 70 includes means such as vacuum holes for securing the receiver sheet thereto for repeated presentations to photoconductive belt 18. As is well known in the art, transfer of the toner image to a receiver sheet is generally accomplished in the presence of an electric field which is created by biasing the transfer drum relative to the conductive layer of belt 18 or to a backing roller 72. This process has been well known in the art for many years; see for example U.S. Pat. No. 3,702,482 to Dolcimascolo et al.

Transfer drum 70 has an aluminum core and a polyurethane outer layer of an intermediate resistivity of, for example $5\times10^9$ ohms-cm. The actual resistivity of the outer layer is an inverse function of relative humidity. See U.S. Pat. No. 3,781,105 to Meagher for a discussion of advantages of intermediate resistivity transfer drums and illustrating the use of a two outer layer drum. The polyurethane layer is sufficiently conductive that it helps establish the electrical field urging transfer.

The power supply 74 for transfer drum 70 is programmed. Each time the reproduction apparatus is activated, power supply 74 operates at a set-point constant current for an initial "adjustment period." During the adjustment period, the transfer drum is in contact with film 18 and the power supply voltage ramps up to deliver the set-point current; thus compensating for changes in resistivity of the outer layer of drum 70 due to relative humidity changes. After the adjustment period, the programmed power supply locks onto the voltage that supplies the set-point current for the reproduction run. Maintaining the drum voltage constant during the production run inhibits voltage spikes as the interframe region of drum 70 passes through the nip.

It is apparent that the voltage to which power supply 74 rises is a function of the conductivity of the transfer drum, and is therefore related its moisture content. As the relative to humidity increases, the transfer drum's conductivity also increases and power supply 74 is required to supply less voltage to maintain the set-point current.

According to the present invention, the voltage to which power supply 74 rises is used as an input signal for automatically adjusting process elements to proper values for the relative humidity.

For example, detack controller 51 can be adjusted to activate detack bias charger 47 for a greater duty cycle or to a higher bias during low humidity conditions than for high humidity conditions. This would maximize detack in dry environments and minimize the creation of ozone in wetter environments.

Another example of adjusting process element values is shown in FIG. 1, wherein a paper dryer 76 is controlled by LCU 24 in response to the input signal from power supply 74. Power to the fan (or a heating element) in the paper dryer is increased during high humidity conditions. Yet another example relates to conditioning the developer mixture in development station 38. Humid conditions tend to necessitate longer exercise of the development mixture to bring the mixture to the correct charge. This could be accomplished in response to a low signal from power supply 74.

Any of the other process element values can be adjusted to compensate for changes in humidity. That is, $V_O$ controller 36 can be regulated to compensate for changes in (1) the degree of charge acceptance of photoconductor member 18, (2) the dark decay rate, and (3) the efficiency of corona chargers, $E_O$ controller 36 and/or $V_B$ controller 40 can be likewise regulated by LCU 24 in response to the input signal from power supply 74.

The invention has been described in detail with particular reference to preferred embodiments thereof, but it will be understood that variations and modifications can be effected within the spirit and scope of the invention.

What is claimed is:

1. An electrostatographic reproduction apparatus comprising:

an image member;

means for transferring a toner image from said image member to a receiver sheet by applying a voltage between said image member and the receiver sheet in a direction urging the toner image to the receiver sheet and of a value characteristic of the ambient relative humidity in the apparatus; and means responsive to the value of said voltage for automatically adjusting the value of at least one electrostatographic process element.

2. An electrostatographic reproduction apparatus as defined in claim 1 wherein said one electrostatographic process element is detack bias.

3. An electrostatographic reproduction apparatus as defined in claim 1 wherein said one electrostatographic process element is detack duration.

4. An electrostatographic reproduction apparatus as defined in claim 1 wherein said one electrostatographic process element is initial voltage $V_O$.

5. An electrostatographic reproduction apparatus as defined in claim 1 wherein said one electrostatographic process element is exposure $E_O$.

6. An electrostatographic reproduction apparatus as defined in claim 1 wherein said one electrostatographic process element is development bias $V_B$.

7. An electrostatographic reproduction apparatus as defined in claim 1 wherein said one electrostatographic process element is copy sheet conditioning.

8. An electrostatographic reproduction apparatus as defined in claim 1 wherein said one electrostatographic process element is copy sheet drying.

9. An electrostatographic reproduction apparatus comprising:

an image member;

means for transferring a toner image from said image member to a receiver sheet by applying an electric field between said image member and the receiver sheet in a direction urging the toner image to the receiver sheet, said transferring means including a programmed power supply adapted to (1) generate a pre-set constant current across the applied electric field during an adjustment period and (2) lock onto the voltage that supplies the set-point current for the remainder of a reproduction run; and means responsive to the value of said voltage for automatically adjusting the value of at least one electrostatographic process element.

* * * * *